US011418864B2

(12) United States Patent
Lu

(10) Patent No.: US 11,418,864 B2
(45) Date of Patent: Aug. 16, 2022

(54) MODULAR HEAD-WEARABLE LOUDSPEAKER SYSTEM

(71) Applicant: Tymphany Acoustic Technology Limited, Taipei (TW)

(72) Inventor: Ryan Meng-Wei Lu, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 17/070,627

(22) Filed: Oct. 14, 2020

(65) Prior Publication Data

US 2021/0112327 A1 Apr. 15, 2021

(30) Foreign Application Priority Data

Oct. 14, 2019 (CN) ..... 201910973728.5

(51) Int. Cl.
*H04R 1/10* (2006.01)

(52) U.S. Cl.
CPC ..... *H04R 1/1008* (2013.01); *H04R 1/105* (2013.01); *H04R 1/1025* (2013.01); *H04R 1/1083* (2013.01); *H04R 2420/07* (2013.01)

(58) Field of Classification Search
CPC ... H04R 1/02; H04R 1/04; H04R 1/10; H04R 1/1008; H04R 1/1016; H04R 1/1025; H04R 1/1056; H04R 1/1066; H04R 1/1083; H04R 1/105; H04R 1/1075; H04R 1/1091; H04R 3/00; H04R 3/005; H04R 3/12; H04R 2420/07
See application file for complete search history.

(56) References Cited

U.S. PATENT DOCUMENTS

2009/0323975 A1* 12/2009 Groesch ..... H04R 5/033 381/71.1
2013/0311176 A1* 11/2013 Brown ..... G10L 21/0272 704/233
2014/0211959 A1* 7/2014 Boyajian ..... H04R 5/033 381/74
2016/0196100 A1* 7/2016 Yow ..... H04R 1/1041 381/74
2018/0217382 A1* 8/2018 Urbach ..... G09G 3/001

* cited by examiner

*Primary Examiner* — Thang V Tran
(74) *Attorney, Agent, or Firm* — Muncy, Geissler, Olds & Lowe, P.C.

(57) ABSTRACT

A modular head-wearable loudspeaker system includes a headphones module and an earphones module, including a principal earphone. The principal earphone includes an earphone loudspeaker, an audio signal processor, an earphone wireless interface, an earphone audio output, and an earphone microphone input. The headphones module includes two earcups interconnected by a flexible headband and comprising respective headphone loudspeakers, a headphone microphone, a mechanical earphone attachment interface detachably attached to the principal earphone, a headphone audio input communicatively connected to the headphone loudspeakers and detachably communicatively connected to the earphone audio output, and a headphone microphone output communicatively connected to the headphone microphone and detachably communicatively connected to the earphone microphone input.

22 Claims, 8 Drawing Sheets

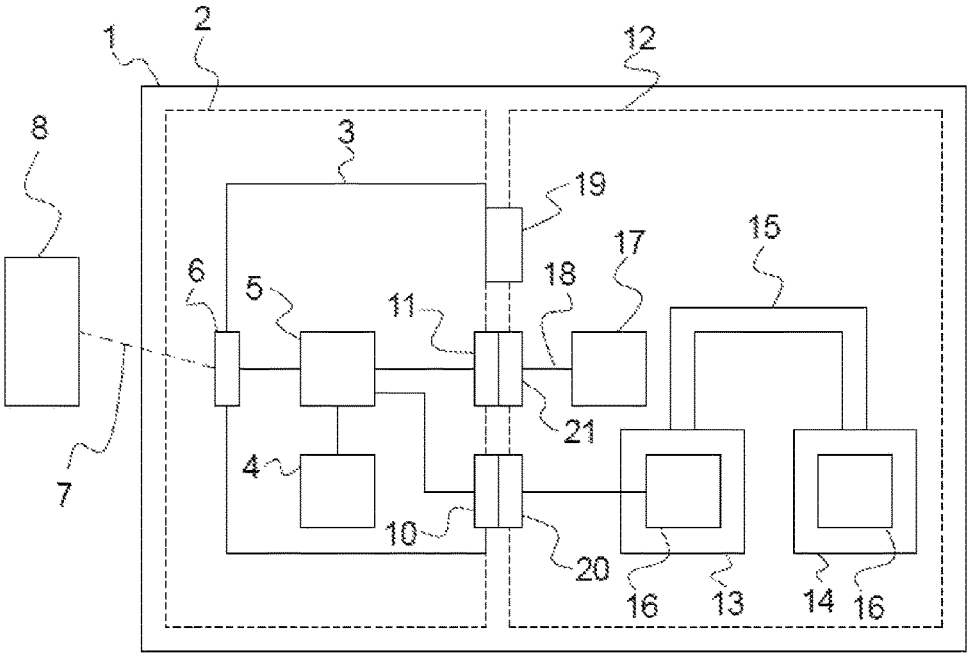

| | |
|---|---|
| 1 | System |
| 2 | Earphones module |
| 3 | Principle earphone |
| 4 | Earphone loudspeaker |
| 5 | Audio signal processor |
| 6 | Earphone wireless interface |
| 7 | Audio signal |
| 8 | Peripheral audio source |
| 10 | Earphone audio output |
| 11 | Earphone microphone input |
| 12 | Headphones module |
| 13 | Earcup |
| 14 | Earcup |
| 15 | Flexible headband |
| 16 | Headphone speakers |
| 17 | Headphone microphone |
| 18 | Headphone microphone signal |
| 19 | Mechanical earphone attachment interface |
| 20 | Headphone audio input |
| 21 | Headphone microphone output |

*Fig. 1*

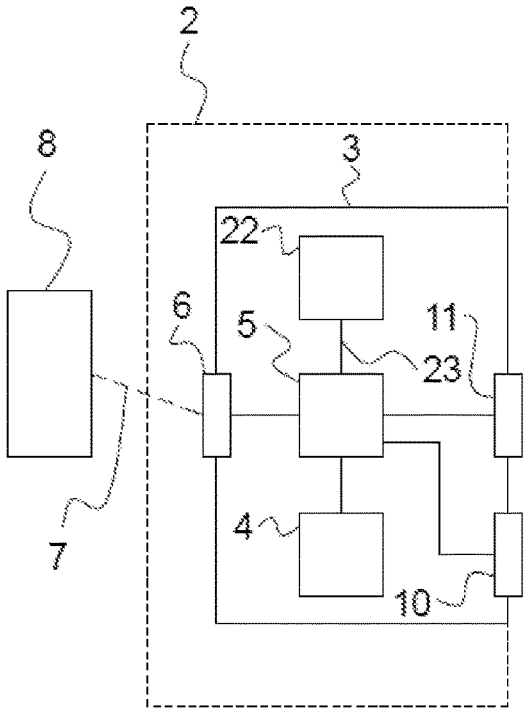

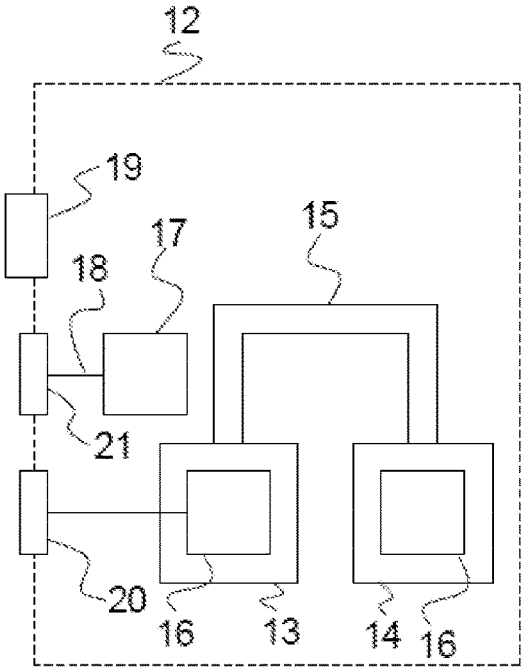

Fig. 3

Fig. 2

| | |
|---|---|
| 1 | System |
| 2 | Earphones module |
| 3 | Principle earphone |
| 4 | Earphone loudspeaker |
| 5 | Audio signal processor |
| 6 | Earphone wireless interface |
| 7 | Audio signal |
| 8 | Peripheral audio source |
| 10 | Earphone audio output |
| 11 | Earphone microphone input |
| 12 | Headphones module |
| 13 | Earcup |
| 14 | Earcup |
| 15 | Flexible headband |
| 16 | Headphone speakers |
| 17 | Headphone microphone |
| 18 | Headphone microphone signal |
| 19 | Mechanical earphone attachment interface |
| 20 | Headphone audio input |
| 21 | Headphone microphone output |
| 22 | Earphone microphones |

| | |
|---|---|
| 2 | Earphones module |
| 3 | Principle earphone |
| 4 | Earphone loudspeaker |
| 5 | Audio signal processor |
| 6 | Earphone wireless interface |
| 9 | Headphone attachment interface |
| 10 | Earphone audio output |
| 11 | Earphone microphone input |
| 22 | Earphone microphones |
| 25 | Earphone battery |
| 26 | Earphone battery interface |

| | |
|---|---|
| 2 | Earphones module |
| 3 | Principle earphone |
| 4 | Earphone loudspeaker |
| 5 | Audio signal processor |
| 6 | Earphone wireless interface |
| 9 | Headphone attachment interface |
| 10 | Earphone audio output |
| 11 | Earphone microphone input |
| 22 | Earphone microphones |
| 24 | Auxilliary earphone |
| 30 | Outer body |

MODULAR HEAD-WEARABLE LOUDSPEAKER SYSTEM

CROSS REFERENCE TO RELATED APPLICATIONS

The present application claims priority to Chinese Patent Application No. CN 201910973728.5, which was filed on Oct. 14, 2019, the entire contents of which are hereby incorporated by reference.

FIELD OF THE INVENTION

The present invention relates to a modular head-wearable loudspeaker system, an earphones module for a modular head-wearable loudspeaker system, a headphones module for a modular head-wearable loudspeaker system, and a method for facilitating processing of signals using a modular head-wearable loudspeaker system.

BACKGROUND OF THE INVENTION

Many different types of head-wearable loudspeaker systems exist, such as earphones and headphones. Typically, different types of such systems are suitable for different types of situations. Smaller models such as in-ear earphones may for example be suitable to use during exercise or transportation, whereas larger over-ear headphones are suitable to provide the best audio quality.

For the user, it is impractical and expensive to acquire different separate types of loudspeaker systems for every type of situation. Furthermore, the environmental footprint from producing all these different types of loudspeaker systems is large.

One approach to this problem is modular loudspeaker systems. Here, an earphone may, for example, be attached and combined with an over-ear headphone. However, attaching an earphone and a headphone introduce new problems. For instance, the attachment of the earphone and the headphone may restrict microphone placement on the earphone and the headphone.

SUMMARY OF THE INVENTION

It is an object of the invention to overcome those above-mentioned problems and challenges related to head-wearable loudspeaker systems, and subsequently an improved head-wearable loudspeaker system is provided.

The invention relates to a modular head-wearable loudspeaker system comprising: an earphones module comprising: a principal earphone comprising: an earphone loudspeaker; an audio signal processor; an earphone wireless interface communicatively connected to said earphone loudspeaker through said audio signal processor for receiving an audio signal from a peripheral audio source communicatively connected to said earphone wireless interface; an earphone audio output communicatively connected to said earphone wireless interface through said audio signal processor; and an earphone microphone input communicatively connected to said audio signal processor; and said modular head-wearable loudspeaker system further comprising a headphones module, said headphones module comprising: a first earcup and a second earcup interconnected by a flexible headband for wearing said headphones module, wherein said first and second earcups comprises headphone loudspeakers such that each of said first and second earcups comprises a respective headphone loudspeaker of said headphone loudspeakers; said headphones module further comprising: at least one headphone microphone for generating at least one headphone microphone signal; at least one mechanical earphone attachment interface detachably attached to said principal earphone; at least one headphone audio input communicatively connected to any of said headphone loudspeakers and detachably communicatively connected to said earphone audio output for providing said audio signal from said earphones module to any of said headphone loudspeakers; and at least one headphone microphone output communicatively connected to at least one of said at least one headphone microphone and detachably communicatively connected to said earphone microphone input for providing at least one of said at least one headphone microphone signal to said audio signal processor.

An exemplary embodiment of the invention comprises an earphones module and a headphones module. The system has three configurations. In a first configuration, the headphones module is used separately from the earphones module. A user wears the headphones module with the earcups on or around the ears. An audio signal or an auxiliary audio signal is provided to the headphones module through a wired connection to a peripheral audio source, e.g. a smartphone or computer. In a second configuration, the earphones module is used separately from the headphones module. The earphones module comprises two earphones; a principal earphone and an auxiliary earphone, which are individual units that can be plugged into different ear canals of a user. Each earphone comprises an audio signal processor, earphone loudspeaker, and various connections/interfaces. They can receive an audio signal from a peripheral audio source through an earphone wireless interface. In a third configuration, the headphones module and the earphones module are combined. The two modules are attached to each other via attachment interfaces. The components of the headphones module are thus able to utilize the components of the earphones module and vice versa. Any components and elements can be shared between the two modules, e.g. loudspeakers, microphones, audio signal processors, batteries, wired and wireless interfaces, various signals, etc. In this embodiment the audio signal processor in the earphones module may for example utilize superior headphone loudspeakers to provide improved audio quality to the user. The audio signal is wirelessly transmitted to the earphones module from a peripheral audio source, and then transmitted to the headphones module through connected output and input terminals of the respective modules. Particularly, the earphones module is further capable of utilizing headphone microphones located in the headphones module.

These three different configurations allow the user to use whatever configuration the user desires. For example, for transportation or exercise, wearing the earphones module may be preferable. For optimal sound quality, the combined modules may be preferable. For audio from a source without wireless capability, wearing the headphones module may be preferable.

Embodiments of the invention may, thus, be able to provide these beneficial configurations for various preferred uses in combination with any other presented advantages.

A modular head-wearable loudspeaker system according to the invention allows a principal earphone without a microphone, but which still has microphone functionality, e.g., active noise control and telecommunication, facilitated by headphone microphones. This is advantageous since it reduces the number of components required for the earphones alone. Particularly, this allows a size reduction of the earphones, which is typically crucial due to the size restriction associated with such in-ear devices. Alternatively, instead of a size-reduction, the invention may allow a larger size of other components of the earphone, e.g., loudspeaker, battery, audio signal processer etc.

Not having microphones in the earphones may further reduce costs and environmental footprint of the earphones which is advantageous.

In some embodiments of the invention, the earphones module may have earphone microphones. However, due to the restricted size of typical earphones, the size, number, and/or quality of microphones in earphones are highly restricted. Headphones do not have the same size restrictions and may, thus, comprise larger microphones, a larger number of microphones, and/or a better quality of microphones, which in turn may improve the microphone signal, compared to a microphone signal based on earphone microphones, which is advantageous. Further, the larger body of the headphones module enables a wider range of possible microphone locations compared to available locations on the earphones module, which is advantageous, e.g., for telecommunication purposes.

By utilizing the audio signal processor of the earphones module, the headphones module does not require an audio signal processor. In fact, the earphones module may be an entirely passive loudspeaker module, i.e., a loudspeaker module without audio signal amplification. Consequently, no battery is required in the loudspeaker module. Accordingly, the cost and environmental footprint of the headphones module alone can be reduced, while the combined modules maintain microphone functions, which is advantageous. Note that in some embodiments of the invention, the headphones module includes a battery and/or an audio signal processor.

A headphone microphone signal recorded by the headphone microphone may further be transmitted to a peripheral device using the wireless interface of the earphones module, which is advantageous, e.g., for telecommunication.

When the two modules are detachably attached through mechanical attachment interfaces, physical access to any microphones located on an earphone may be restricted by the presence of the headphones module, which potentially severely distorts and/or reduces the sound recorded by an earphone microphone when the two modules are attached to each other. By utilizing headphone microphones, the earphone microphones can be placed freely on the earphones, since they may not be required when the two modules are attached to each other, which is advantageous. In fact, the invention advantageously allows optimal microphone placement in any configuration. Further, the invention enables a wider range of designs of attachment interfaces, since these do not necessarily need to take into account the placement of earphone microphones, which is advantageous.

An aspect of the invention relates to an earphones module for a modular head-wearable loudspeaker system, said earphones module comprising: a principal earphone comprising: an earphone loudspeaker; an audio signal processor; at least one earphone microphone for generating at least one earphone microphone signal wherein said at least one earphone microphone is communicatively connected to said audio signal processor; an earphone wireless interface communicatively connected to said earphone loudspeaker through said audio signal processor for providing an audio signal to said earphone loudspeaker from a peripheral audio source communicatively connected to said earphone wireless interface; an earphone audio output communicatively connected to said earphone wireless interface through said audio signal processor and arranged to detachably connect with an earphone audio input of a headphones module for providing said audio signal from said peripheral audio source to said headphones module; and an earphone microphone input communicatively connected to said audio signal processor and arranged to detachably connect with a headphone microphone output of said headphones module for receiving a headphone microphone signal by said audio signal processor from said headphones module; wherein said audio signal processor is configured to process at least one of said at least one earphone microphone signal when said headphones module is detached, and said headphone microphone signal when said headphones module is attached.

An earphones module according to the invention is advantageous since it is potentially combinable with a headphones module and may, thus, be usable for any of the configurations, purposes, and advantages which a modular head-wearable loudspeaker system according to the invention has.

Processing a microphone signal, e.g., a headphone microphone signal or an earphone microphone signal, may, for example, comprise generating an active noise control signal based on one of the microphone signals, or forwarding the microphone signals for telecommunication purposes. Note that including one microphone signal in such processing does not exclude including another microphone signal. A headphone microphone signal and an earphone microphone signal may thus be used in the same process, e.g., generating an active noise control signal.

An aspect of the invention relates to a headphones module for a modular head-wearable loudspeaker system, said headphones module comprising: a first earcup and a second earcup interconnected by a flexible headband for wearing said headphones module, wherein said first and second earcups comprises headphone loudspeakers such that each of said first and second earcups comprises a respective headphone loudspeaker of said headphone loudspeakers; said headphones module further comprising: at least one headphone microphone for generating at least one headphone microphone signal; at least one mechanical earphone attachment interface arranged to detachably attach an earphones module; at least one headphone audio input communicatively connected to any of said headphone loudspeakers and arranged to detachably connect with a headphone audio output of said earphones module for providing an audio signal received from said earphones module to any of said headphone loudspeakers; and at least one headphone microphone output communicatively connected to at least one of said at least one headphone microphone and arranged to detachably connect with an earphone microphone input of said earphones module for providing at least one of said at least one headphone microphone signal from said headphone microphone to said earphones module.

A headphones module according to the invention is advantageous since it is potentially combinable with an earphones module and may, thus, be usable for any of the configurations, purposes, and advantages which a modular head-wearable loudspeaker system according to the invention has.

Attaching an earphones module may be understood as attaching an earphone of an earphones module.

An aspect of the invention relates to a method for facilitating processing of a headphone microphone signal, said method comprising the steps of: attaching a principal earphone of an earphones module to a mechanical earphone attachment interface of a headphones module; communicatively connecting a headphone microphone output of said headphones module with an earphone microphone input of said principal earphone; recording said headphone microphone signal using a headphone microphone of said headphones module; transmitting said headphone microphone signal to an audio signal processor of said principal earphone via said headphone microphone output and said earphone microphone input; and processing said headphone microphone signal on said audio signal processor.

By attaching an earphones module and a headphones module and communicatively connecting a headphone microphone output with an earphone microphone input, it is, thus, possible to share signals and components. Particularly, the headphone microphone signal can be processed by the audio signal processor of the principal earphone. Accordingly, the method of the invention may have any of the same advantages that a modular head-wearable loudspeaker system according to the invention has.

THE DRAWINGS

Various embodiments of the invention will now be described with reference to the figures where FIG. 1 illustrates a schematic overview of a head-wearable loudspeaker system according to an embodiment of the invention;

FIG. 2 illustrates a schematic overview of an earphones module according to an embodiment of the invention;

FIG. 3 illustrates a schematic overview of a headphones module according to an embodiment of the invention;

Figure 5A:
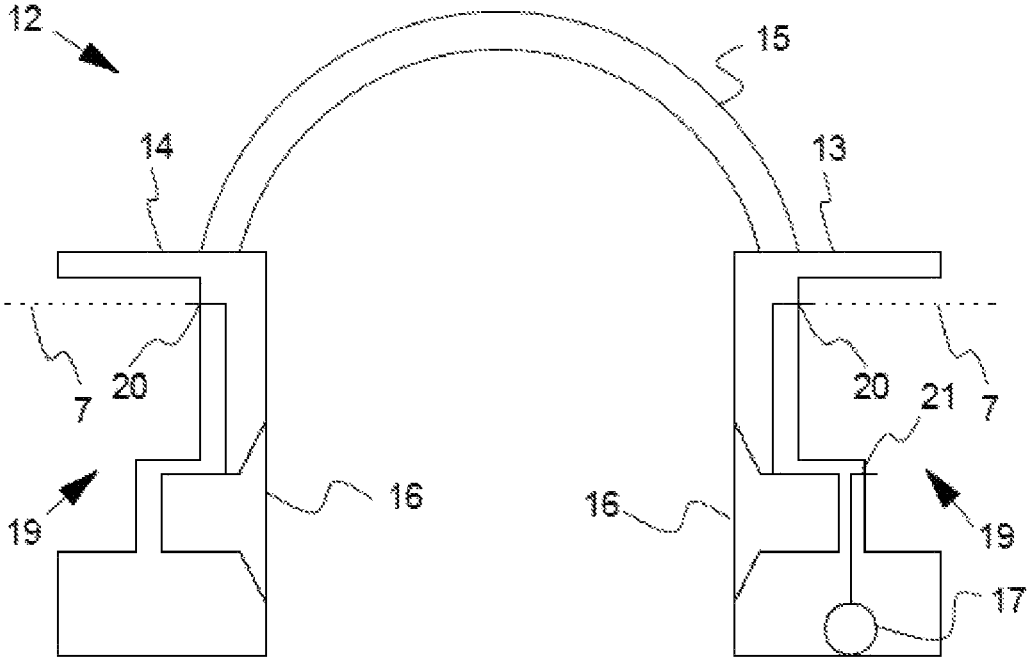
Figure 5B:
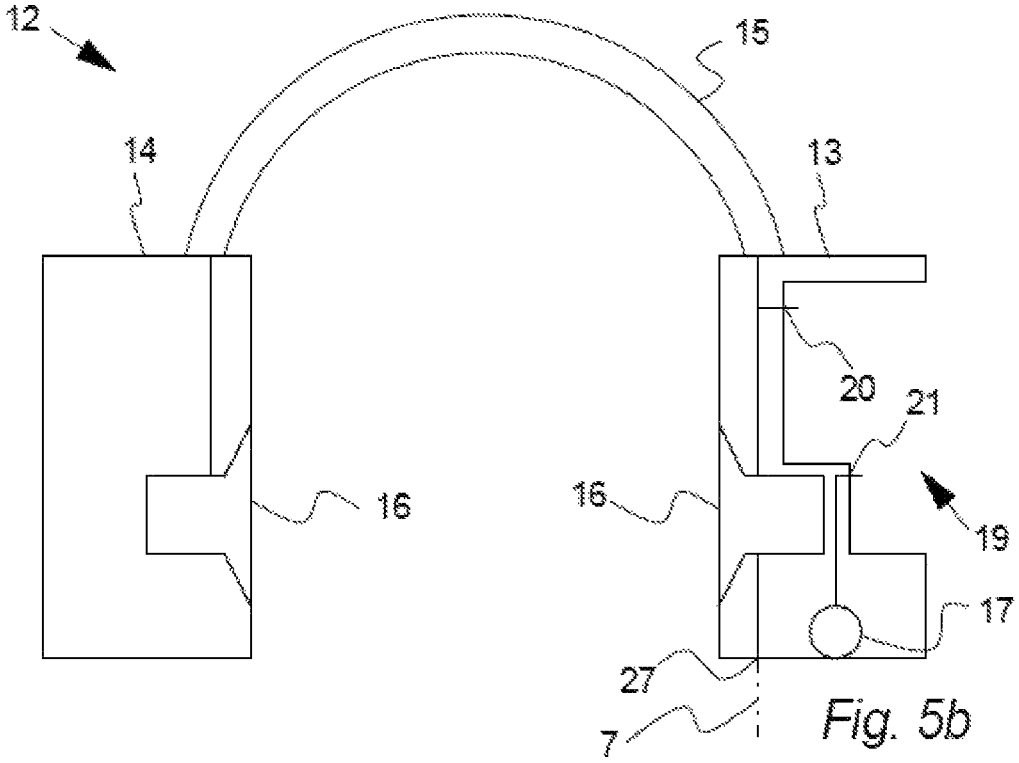
Figure 5C:
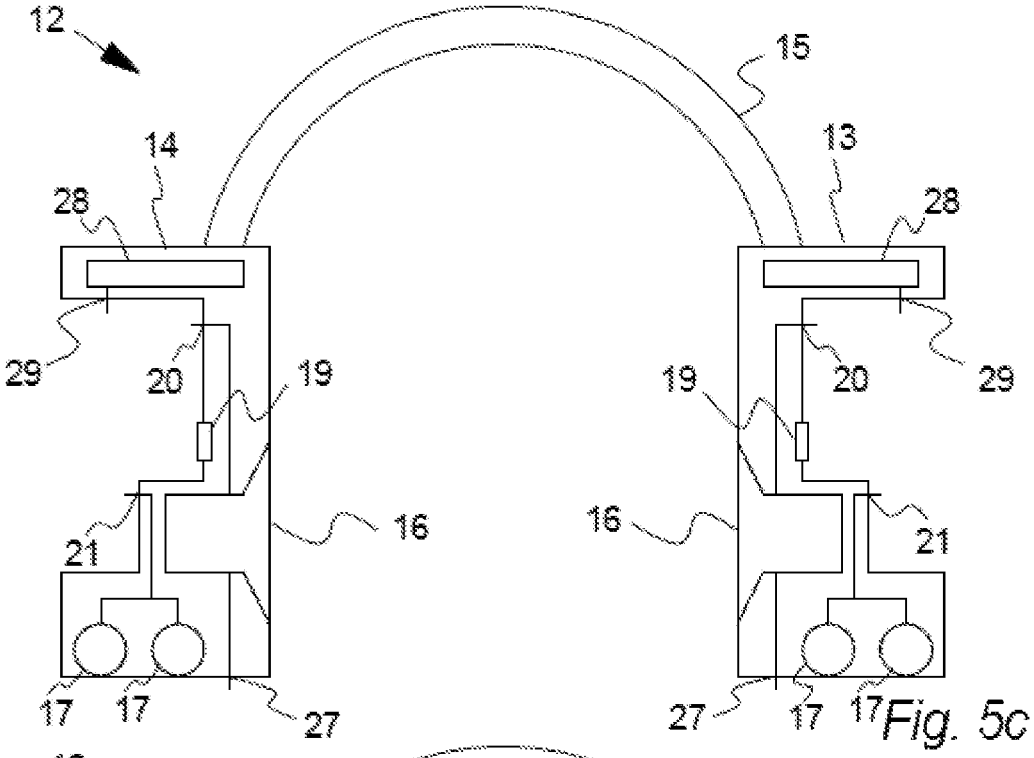
Figure 6:
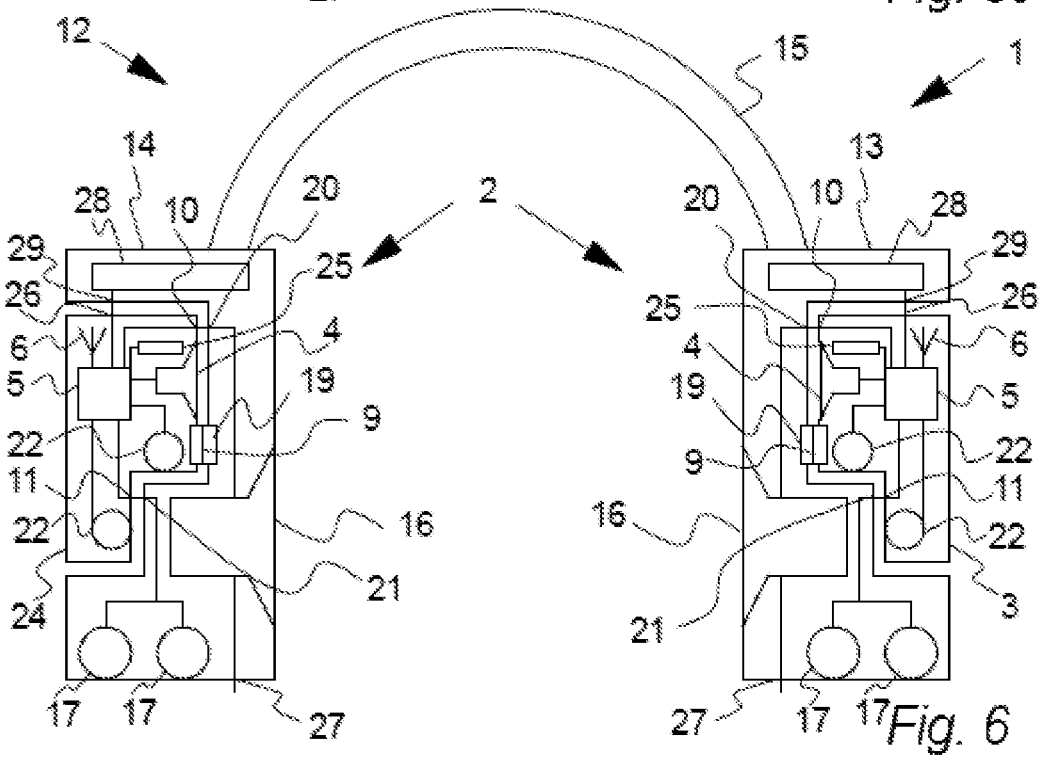
Figure 7:
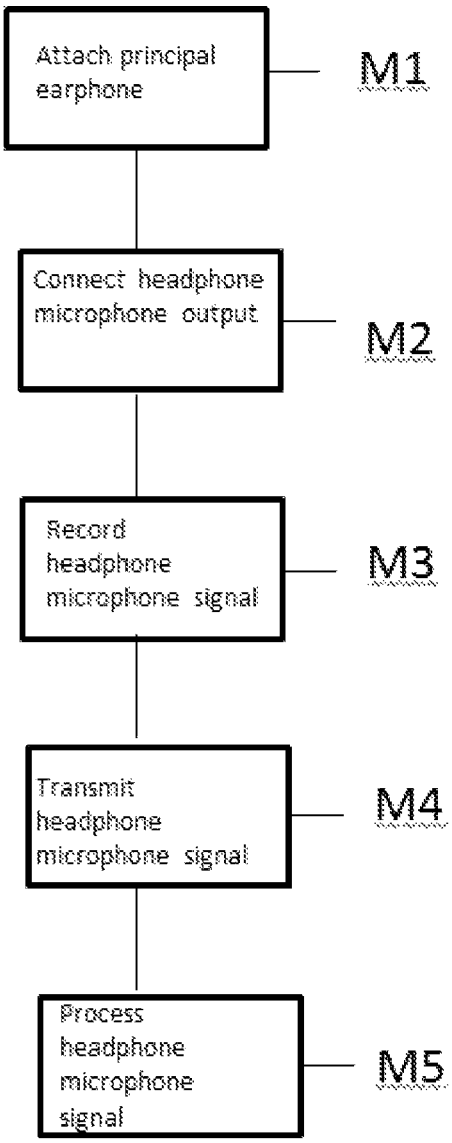
Figure 8:
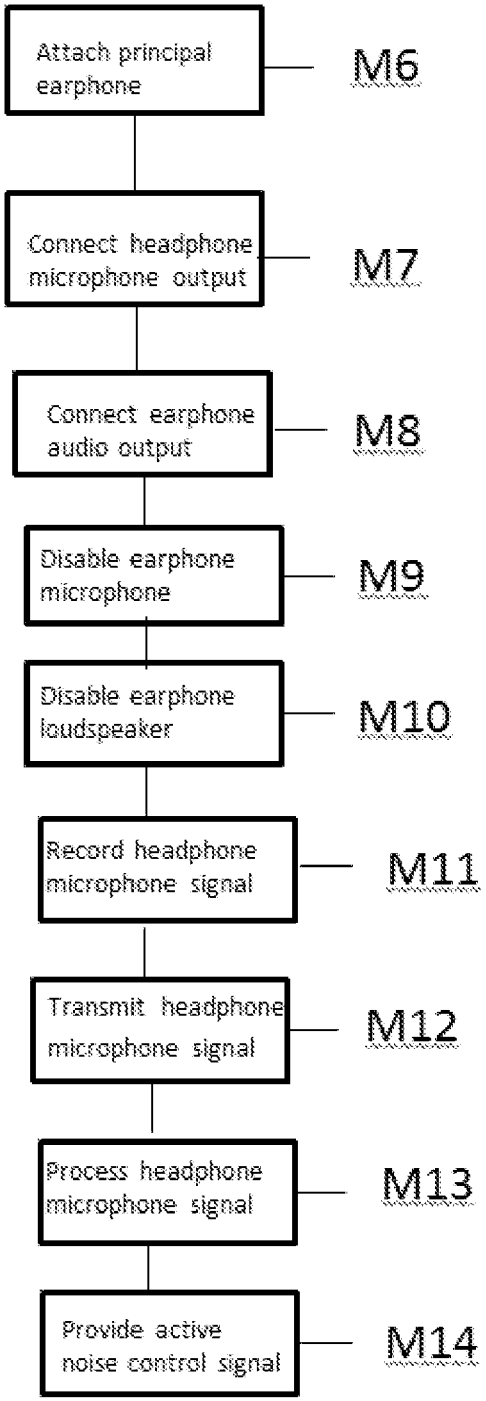

FIG. 4*a-d* illustrate various embodiments of an earphones module according to the invention;

FIG. 5*a-c* illustrate various embodiments of a headphones module according to the invention;

FIG. 6 illustrates another embodiment of a head-wearable loudspeaker system according to the invention;

FIG. 7 illustrates method steps according to an embodiment of the invention; and FIG. 8 illustrate method steps according to another embodiment of the invention.

DETAILED DESCRIPTION

In the following, various concepts of the invention are presented without reference to particular embodiments.

An earphone of an earphones module, e.g., the principal earphone or an auxiliary earphone, is typically designed to fit into the outer ear of a user. When worn, it may, for example, extend at least partially into the ear canal of a user. An earphone may also be referred to as an in-ear headphone, an earbud, an earpiece, or a hearable.

A headphones module is substantially larger than an earphone of the earphones module. The headphones module may, for example, have a circumaural headphone design, where the earcups of the headphones module are designed to be larger than the auricle/pinna of a user. Circumaural headphones may also be referred to as full-size headphones or over-the-ear headphones.

The headphones module may also have a supra-aural headphone design, where each earcup of the headphones module is pushed onto the outer ear in the direction of the ear canal, resting on the auricle. A supra-aural headphone may typically have earcups of a size which is similar to the auricle. Supra-aural headphones may also be referred to as on-ear headphones. The earcups are connected by a flexible headband for wearing the headphones module. The flexible headband may typically have an elongated or a slender shape and a half-circular geometry to allow the earcups to rest onto or around the ears of the user. A flexible headband may also be understood as an elongate flexible strip or a slender flexible strip.

The earphones module and the headphones module are detachably attachable to each other via attachment interfaces, e.g., magnets, clamps, or one or more grooves. In typical embodiments, the headphone audio input and the earphone audio output are arranged to be connected automatically upon attachment of the two modules. This input and output may for example comprise terminals which contact each other upon attachment of the modules. The input and output may also be a plug and a socket or vice versa. In some embodiments, one or more plugs and one or more sockets serve as the attachment interface, i.e., upon insertion of a plug into the socket, the earphones module and the headphones modules are attached. Similarly, the headphone microphone output and the earphone microphone input may automatically connect upon attachment of the two modules, e.g., as terminals and/or as plugs/sockets. The inputs and outputs may also be wirelessly connected to each other. Note that the invention is not restricted to automatic connection upon attachment of modules. It may, thus, be understood that the two connections may be detachably communicatively connected with each other by the user and/or automatically. Two connections being detachably communicatively connected may for example be understood as these two connections being arranged to be connected and disconnected with each other, for example, by the user or automatically. Two connections may for example be arranged to be connected upon mechanical attachment of the two modules and disconnected upon mechanical detachment of the two modules. The two connections may be connected with each other or disconnected with each other communicatively. For example, upon the attachment/detachment of the two modules, connections are connected/disconnected, e.g., wirelessly.

An earphones module may typically comprise both a principal earphone and an auxiliary earphone, although embodiments of the invention may alternatively just have a principal earphone. Similarly, attaching the two modules such that they can share components may require attaching just the principal earphone, or may require attaching both the principal earphone and an auxiliary earphone. Accordingly, different embodiments of the headphones module may comprise earphone attachment interfaces for one or two earphones. In some embodiments of the invention, the principal earphone can provide an audio signal to both headphone loudspeakers of the headphones module, and in some embodiments, the principal earphone can provide an audio signal to one earphone loudspeaker, whereas an auxiliary earphone can provide an audio signal to the other earphone loudspeaker.

In some embodiments, the auxiliary earphone comprises substantially similar components as the principal earphone. It may for example be used alone and can on its own also be attached to the headphones module such that the auxiliary earphone and the headphones module can share elements. Typically, an outer body of the auxiliary earphone mirrors an outer body of the principal earphone, such that the two earphones can fit into opposite ears of the user. In some embodiments, the principal earphone and the auxiliary earphone may function as a master and a slave in terms of communication. For example, the principal earphone may serve as a communication hub with any peripheral audio source and govern which audio signal the auxiliary earphone replays on the loudspeaker.

Any of the earphones may further comprise RF communication, battery, CPU, memory, storage, etc. One or more of these elements may, for example, be an integrated part of the audio signal processor, but they may also be separate elements. An audio signal processor may for example be a digital signal processor.

The wireless interface may, for example, be suitable for Bluetooth communication and/or the earphones module may be arranged to communicatively couple to a peripheral device such as a smartphone.

Microphone functions/microphone functionality may, for example, be understood as any functions or uses, which require microphones, e.g., active noise control, telecommunication, voice control/voice commands, etc.

In some embodiments, when the headphones module is worn separately, it may receive an auxiliary audio signal, e.g., from a peripheral audio source, through one or more headphone audio inputs. In other embodiments, it may receive an auxiliary audio signal through a dedicated peripheral audio input.

In various embodiments of the invention, the audio signal processor of the principal earphone may or may not apply filters, amplification, attenuation, delays, audio signal analysis, digital-to-analogue conversion, analog-to-digital conversion, etc., to a signal before transmitting it. For example, if an audio signal is received through the earphone wireless interface, the audio signal processor may amplify and/or convert that audio signal before it is provided to an earphone loudspeaker or a headphone loudspeaker via the earphone audio output. Similarly, it may convert a microphone signal, e.g., the headphone microphone signal, before transmitting it to a peripheral device via the earphone wireless interface. Audio signals and microphone signals are not restricted to particular formats (digital, analogue, current, voltage, wireless) in the context of this invention.

In some embodiments of the invention, an audio signal and/or a microphone signal is amplified by an amplifying element separate from the audio signal processor. In some embodiments of the invention, an audio signal and/or a microphone signal is attenuated by an attenuating element separate from the audio signal processor. In some embodiments, an audio signal and/or a microphone signal is converted by a separate digital-to-analog conversion and/or analog-to-digital conversion element.

FIG. 1 illustrates a schematic overview of a modular head-wearable loudspeaker system 1 according to an embodiment of the invention. The system 1 features two modules: an earphones module 2 and a headphones module 12. These two modules 2, 12 are detachably attached and capable of being connected and disconnected. Each of the individual modules 2, 12 can also be worn and/or used separately, without requiring attachment and connection to the other module.

The earphones module 2 comprises a principal earphone 3. In some embodiments of the invention, the earphones module further features an auxiliary earphone. This auxiliary earphone may for example comprise elements similar to the elements of the principal earphone, e.g., an earphone loudspeaker, for example such that a user may wear and use the principal earphone 3 and the auxiliary earphone in each respective ear.

The principal earphones 3 comprise an earphone loudspeaker 4, an audio signal processor 5, an earphone wireless interface 6, an earphone audio output 10, and an earphone microphone input 11. An audio signal 7 may be transmitted wirelessly to the principal earphone 3 from a peripheral audio source 8 via the earphone wireless interface 6. This audio signal 7 may then, for example, be provided to the earphone loudspeaker 4 via the audio signal processor 5 where it is converted to a format which the earphone loudspeaker 4 may receive to reproduce the audio signal 7 as sound. Thus, a user can, for example, wear the principal earphone 3 and listen to audio, e.g., music, supplied as an audio signal 7 to the principal earphone 3 from a peripheral audio source 8, e.g., a smartphone. The audio signal 7 may also be provided to the earphone audio output 10 via the audio signal processor, and from the earphone audio output, the audio signal 7 can be supplied to the headphones module 12 via the headphones audio input 20 of the headphones module 12.

The destination to which the audio signal 7 is provided may, for example, be determined by the audio signal processor 5 automatically, e.g., by sensing whether a headphones module 12 is attached to the earphones module 2. Or it may be determined manually, e.g., by via a voice command or a switch/button, e.g. a physical switch located on the principal earphone 3. In some embodiments, the principal earphone provides the audio signal to both the earphone loudspeaker 4 and the earphone audio output 10.

The audio signal processor 5 is communicatively connected to the earphone microphone input 11, such that when a headphone microphone signal 18 is received by the earphone microphone input 11 from the headphones module 12, this signal 18 may be provided to the audio signal processor 5. From here it is processed, e.g., for purposes of active noise control, telecommunication, and/or voice commands. The headphone microphone signal 18, or a processed version of the headphone signal 18, may, thus, for example, be passed to a loudspeaker 4, 16 or to the wireless interface 6.

The shape of the principal earphone is not indicated in the schematic illustration of FIG. 1, but typically, the principal earphone is shaped to fit to the outer ear and/or the ear canal of a user. Note, however, that the earphone of the invention is not restricted to any particular shape.

The headphones module comprises earcups 13,14 comprising respective headphone speakers 16, a flexible headband 15, a headphone microphone 17 for generating a headphone microphone signal 18, a mechanical earphone attachment interface 19, a headphone audio input 20, and a headphone microphone output 21.

The flexible headband 15 connects to two earcups. It allows the headphones module to be worn on, around, and/or over the head of a user, typically such that an earcup 13,14 is gently pressed onto each ear of the user while the headband 15 rests on top of the head. The headband 15 may comprise communicative connections between elements of the two earcups 13,14, for example such that an audio signal 7 can be transmitted from one earcup to the other. It may also comprise other elements, such as a headphones battery, headphone microphones 17, attachment interfaces 19, inputs/outputs 20, 21, etc. Note however that the various elements of the headphones module 12 are not restricted to particular locations on the module. Typically, all of the elements are, however, at least partly, such as fully mechanically connected, such that the headphones module 12 constitutes one wearable unit. In contrast, the earphones module 2 may for example be separated into two separate units facilitated by a principal earphone 3 and an auxiliary earphone.

Any audio signal received by the headphones module 12, e.g., via the headphone audio input 20 connected to the earphones audio output 10, is provided to any of the headphone loudspeakers 16. Any headphone microphone signal 18 recorded by the headphone microphone 17 is provided to the earphones module 2 through the headphone microphone output 21 connected to the earphone microphone input 11. Thus, the two modules are advantageously able to share elements and signals.

The two modules are attached to each other via the mechanical earphone attachment interface 19. This interface may, for example, be a ridge, groove, case or compartment, in which the principal earphone is attachable and detachable. It may also be based on a fastener, such as a clamp, a clasp, or a lock. It may also be based on one or more magnets, which typically requires a magnet on the principal earphone as well.

The attachment interface 19 may be physically located on the earphones module 12 in association with the headphone audio input 20 and/or the headphone microphone 21. This may, for example, at least partly ensure that the headphone audio input 20 is connected to the earphone audio output 10 and that the headphone microphone output 21 is connected to the earphone microphone input 11 whenever the two modules 2, 12 are attached to each other. This connection of inputs and outputs 10, 11, 20, 21 may for example happen automatically upon attachment of the two modules 2, 12. The connection may also require at least some manual contribution. In some embodiments, some of the inputs and outputs 10, 11, 20, 21 may be designed as plugs and sockets, where the two modules are attached to each other by plugging plugs into sockets. Such plugs and sockets may function, in practice at least, as part as the mechanical headphone attachment interface 9. The inputs and outputs 10, 11, 20, 21 may also be wireless, i.e. be connectable without a terminal of an input being in physical/mechanical contact with the associated output. In such cases the connection may for example be established automatically upon attachment of the two modules 2, 12 with each other, or upon sensing that the modules 2, 12 are in close vicinity with each other. A wireless connection may also be established based on manual input, e.g., by a touch on a button or a voice command.

FIG. 2 illustrates a schematic overview of an earphones module 2 according to an embodiment of the invention. The earphones module 2 is in essence similar to the earphones module 2 illustrated in FIG. 1, but the earphones module 2 in FIG. 2 operates independently of a headphones module. Further, it comprises an earphone microphone 22 for generating an earphone microphone signal 23.

An audio signal 7 may be received from a peripheral device 8 via the earphone wireless interface and provided to the earphone speaker 4.

In this configuration, i.e., when separated from the headphones module, the earphone audio output 11 and the earphone microphone input 10 may not be used for signal communication, but they are configured for and are ready to connect to a headphones module 12 such that signals and components can be shared between the modules.

The audio signal processor 5 is configured to process the earphone microphone signal 23 when the headphones module is not connected. Further, the audio signal processor is configured to process a headphone microphone signal received from a headphones module via the earphone microphone input 10 whenever a headphones module is attached. The processing of any of the earphone and microphone signals may for example be for purposes of telecommunication or active noise control. Processing one microphone signal does not exclude processing the other microphone signal. For example, in some embodiments, both microphone signals are processed to generate an improved active noise control signal whenever the two modules are connected.

FIG. 3 illustrates a schematic overview of a headphones module 12 according to an embodiment of the invention. The headphones module 12 is in essence similar to the headphones module 12 illustrated in FIG. 1, but the headphones module 12 in FIG. 3 operates independently of an earphones module.

In this configuration, i.e., separated from the earphones module, the earphone headphone microphone output 21 and the earphone microphone input 10 may not be used for signal communication, but they are configured for and are ready to connect to an earphones module 12 such that signals and components can be shared between the modules.

In some embodiments, the headphones module 12 may receive an audio signal, for example from a peripheral device such as a smartphone or a computer, via the headphones audio input, for example through a wired connection between the peripheral device and the headphones audio input. A received audio signal may then be provided to any of the headphone loudspeakers 16.

In some embodiments, the headphones module 12 may further comprise additional elements, such as an audio signal processor, wireless interface, etc. These components may for example perform some of the same tasks which similar components of the principle earphone performs, e.g., facilitation of wireless communication, signal processing, etc.

FIG. 4*a-d* illustrate various embodiments of an earphones module 2 according to the invention.

Figure 4A:
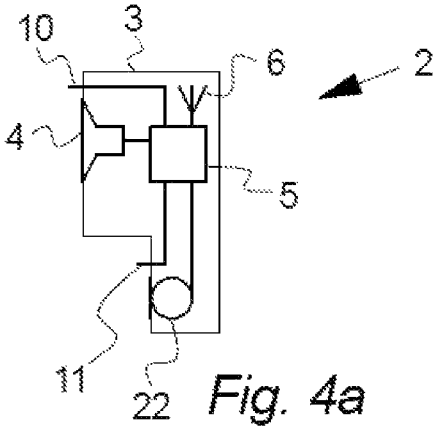

FIG. 4*a* illustrates an embodiment of an earphones module 2 comprising a principal earphone 3. The principal earphone 3 comprises an earphone loudspeaker 4, an audio signal processor 5, an earphone wireless interface 6, an earphone audio output 10, an earphone microphone output 11, and an earphone microphone 22 for providing an earphone microphone signal.

Figure 4B:
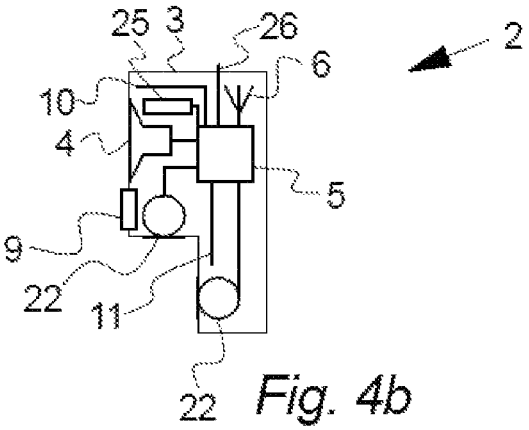

FIG. 4*b* illustrates another embodiment of an earphones module 2 comprising a principal earphone 3. The principal earphone 3 comprises an earphone loudspeaker 4, an audio signal processor 5, an earphone wireless interface 6, a mechanical headphone attachment interface 9, an earphone audio output 10, an earphone microphone output 11, two earphone microphones 22 for providing earphone microphone signals, an earphone battery 25, and an earphone battery interface 26. The earphone audio output 10 and the earphone microphone input 11 are arranged to receive signals wirelessly. The battery interface 26 may, for example, be used to charge/power the earphone battery 25. In some embodiments of the invention, the earphone battery 25 is charged wirelessly, e.g., via induction. The headphone attachment interface 9 includes a magnet.

Figure 4C:
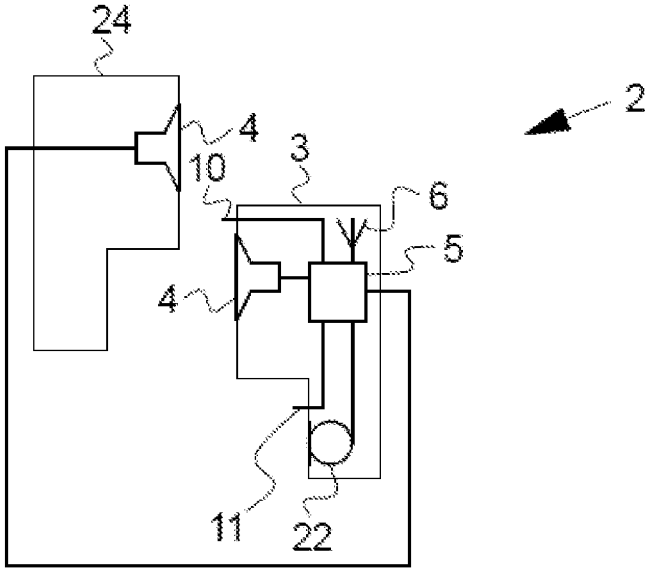

FIG. 4*c* illustrates an embodiment of an earphones module 2 comprising a principal earphone 3 and an auxiliary earphone 24. The principal earphone 3 comprises an earphone loudspeaker 4, an audio signal processor 5, an earphone wireless interface 6, an earphone audio output 10, an earphone microphone output 11, and an earphone microphone 22 for providing an earphone microphone signal. The auxiliary earphone 24 comprises an earphone loudspeaker 4 and is wired to the principal earphone 3, such that an audio signal can be provided to the auxiliary earphone 24 from the earphone wireless interface 6.

Figure 4D:
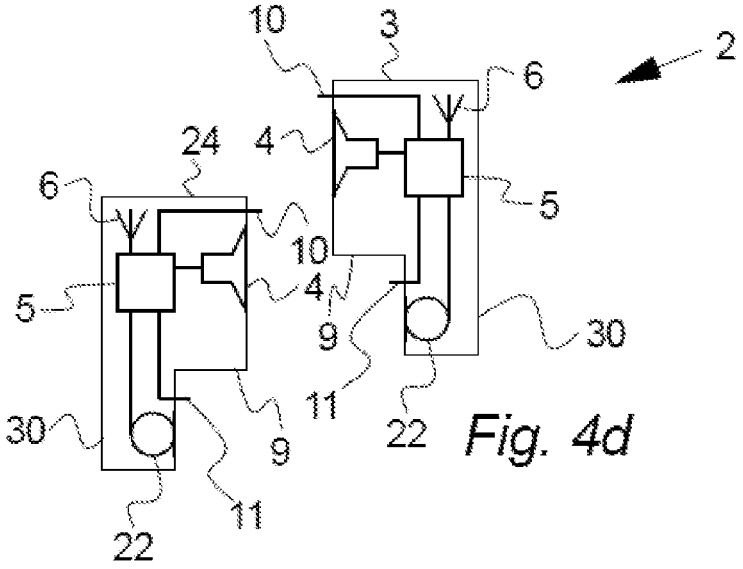

FIG. 4*d* illustrates an embodiment of an earphones module 2 comprising a principal earphone 3 and an auxiliary earphone 24. Each of the earphones 3,24 comprises an earphone loudspeaker 4, an audio signal processor 5, an earphone wireless interface 6, an earphone audio output 10, an earphone microphone output 11, and an earphone microphone 22 for providing an earphone microphone signal. An outer body 30 of each of the earphones 3,24 is shaped to fit into earphone attachment grooves of a headphones module. Thus, the outer bodies 30 of the earphones function as headphone attachment interfaces 9. The two earphones 3,24 comprise the same elements and may, thus, independently receive audio signals, process microphone signals, etc. In some embodiments of the invention, one of the earphones is a master earphone and the other is a slave earphone, wherein the slave earphone provides an audio signal to the earphone loudspeaker based on input from the master earphone. The master earphone may further function as a communication hub, e.g., for communication of the earphones module with a peripheral audio source.

In other embodiments of the invention, a part of the outer body 30 of a peripheral earphone is shaped to fit into a mechanical earphone attachment interface of a headphones module.

FIG. 5*a-c* illustrate various embodiments of a headphones module 12 according to the invention.

FIG. 5*a* illustrates an embodiment of a headphones module 12 comprising two earcups 13, 14 with respective headphone loudspeakers 16, a flexible headband 15, a headphone microphone 17 for providing a headphone microphone signal, two headphone audio inputs 20, and a headphone microphone output 21. Each of the earcups 13, 14 has a mechanical earphone attachment interface 19 in the form of a cavity/groove shaped to receive an earphone for detachable attachment, e.g., detachable attachment of an earphone of an earphones module. The attachment interfaces 19 are located together with the headphone audio inputs 20 and the headphone microphone output. Thus, when earphones of an earphones module are inserted into the attachment interfaces 19, these inputs and outputs can connect with outputs and inputs of the earphones. Only the attachment interface 19 of the first earcup 13 has a headphone microphone output 21. Thus, only an earphone, e.g., a principal earphone, attached to this attachment interface may receive the headphone microphone signal of the microphone output. Both attachment interfaces have a headphone audio input, and accordingly, an earphone attached to any of the earcups 13, 14 through an attachment interface may provide an audio signal 7 to that earcup. Separately from an earphone, the headphones module 12 may receive an audio signal 7 through the headphone audio inputs 21, e.g., from a wired connection to a peripheral audio source.

FIG. 5*b* illustrates an embodiment of a headphones module 12 comprising two earcups 13, 14 with respective headphone loudspeakers 16, a flexible headband 15, a headphone microphone 17 for providing a headphone microphone signal, a headphone audio input 20, and a headphone microphone output 21. In contrast to the embodiment illustrated in FIG. 5*a*, the embodiment of FIG. 5*b* comprises only one mechanical earphone attachment interface 19 for detachably attaching an earphone of an earphones module. An audio signal provided by an earphone to the headphone audio input 20 in the first earcup 13 may be provided to the headphone loudspeaker 16 of the second earcup 16 through a wired connection through the flexible headband. Further, this embodiment has a peripheral audio input 27, separate from the headphone audio input 20, for receiving an audio signal 7, for example, through a connection with a peripheral audio source.

FIG. 5*c* illustrates an embodiment of a headphones module 12 comprising two earcups 13, 14 and a flexible headband 15, where each of the earcups 13, 14 comprises a headphone loudspeaker 16, two headphone microphones 17, a mechanical earphone attachment interface 19, a headphone audio input 20, a headphone microphone output 21, a peripheral audio input 27, a headphone battery 28 an a headphone battery interface 29. The earphone attachment interface 19 may, for example, be a magnet arranged to connect with a magnet of an earphone of an earphones module. When an earphone is connected, it can communicatively connect with the headphone audio input 20, the headphone microphone output 21, and the headphone battery interface 29.

In the illustrated embodiment, only one headphone microphone output 21 is shown for each earcup 13, 14 such that each headphone microphone output 21 is communicatively connected to two headphone microphones 17. In other embodiments of the invention, each headphone microphone 17 has its own dedicated headphone microphone output 21. For example, an embodiment with four headphone microphones has four headphone microphone outputs.

In embodiments of the invention, a headphone battery may power elements such as audio amplifiers, audio signal processors, etc.

FIG. 6 illustrates another embodiment of a modular head-wearable loudspeaker system 1 according to the invention. The loudspeaker system 1 comprises a headphones module 12 and an earphones module 2, wherein the earphones module 2 comprises a principal earphone 3 and an auxiliary earphone 24.

The headphones module 12 is in essence similar to the embodiment illustrated in FIG. 5*c*. Each of the earphones 3, 24 of the earphones module is in essence similar to the principal earphone illustrated in FIG. 4*b*, except that the earphone audio outputs 10 and the earphone microphone inputs 11 of the earphones of FIG. 6 are arranged to connect to the headphone audio input 20 and the headphone microphone output 21 through galvanic terminal connections in contrast to wirelessly.

The two modules 2, 12 are detachably attached via the mechanical headphone attachment interfaces 9 and the mechanical earphone attachment interfaces 19, e.g., through magnetic coupling. For each earphone 3, 24 and associated earcup 13, 14, the earphone microphone input 11 is connected to the headphone microphone output 21, the earphone audio output 10 is connected to the headphone audio input 10, and the earphone battery interface 26 is connected to the headphone battery interface 29.

Through the battery interfaces 26, 29, the two modules 2, 12 may share power of the batteries 25, 28. Further, power from a headphone battery 28 may be used to charge an earphone battery 25. In some embodiments of the invention, the battery interfaces 26, 29 are galvanically separated and based on inductive coils for power transfer.

In some embodiments of the invention, a left earcup of the earcups 13, 14 is arranged to receive a left earphone of the earphones 3, 24 and a right earcup of the earcups 13, 14 is arranged to receive a right earphone of the earphones 3, 24. The earphones module 2 and the headphones module 12 are constructed such that correct attachment of the modules 2, 12 ensures connections between inputs, outputs, and interfaces between the modules 2, 12.

FIG. 7 illustrates method steps according to an embodiment of the invention. The method relates to facilitating processing of a headphone microphone signal.

In a first step M1, a principal earphone of an earphones module is attached to a mechanical earphone attachment interface of a headphones module.

In a next step M2, a headphone microphone output of the headphones module is communicatively connected with an earphone microphone input of the principal earphone. The communicative connection is capable of being connected and disconnected according to user's preference. Further, the connection may be, at least partly, a wireless connection, or it may be a galvanic connection.

In a next step M3, the headphone microphone signal is recorded using a headphone microphone of the headphones module.

In a next step M4, the headphones microphone signal is transmitted to an audio signal processor of the principal earphone via the headphone microphone output and the earphone microphone input. Depending on the type of connection between the two outputs, the transmission may be wired or, at least partly, wireless. In some embodiments, the headphone microphone signal is processed in an audio signal processor of the headphones module prior to the transmission.

In a next step M5, the headphone microphone signal is processed on the audio signal processor of the principal earphone. This processing may, for example, be for establishing an active noise control signal, or to establish a peripheral communication signal for wireless transmission in relation to telecommunication.

In some embodiments of the invention, the steps of attaching a principal earphone M1 and communicatively connecting a headphone microphone output M2 are performed as a single step by a user of the earphones module and the headphones module. For example, as the principal earphone is attached to the headphones module, the headphone microphone output is automatically connected to/with the earphone microphone input.

FIG. 8 illustrates method steps according to another embodiment of the invention. The method relates to facilitating processing of a headphone microphone signal.

In a first step M6, a principal earphone of an earphones module is attached to a mechanical earphone attachment interface of a headphones module.

In a next step M7, a headphone microphone output of the headphones module is communicatively connected with an earphone microphone input of the principal earphone.

In a next step M8, an earphone audio output of the principal earphone is communicatively connected with a headphone audio input of the headphones module. The headphone audio input is communicatively connected to a headphone loudspeaker of the headphones module, for example, a headphone loudspeaker located in an earcup of the headphones module. The communicative connection can be an on/off connection. Further, the connection may be, at least partly, a wireless connection, or it may be a galvanic connection.

In a next step M9, an earphone microphone of the principal earphone is communicatively disabled. An audio signal processor of the principal earphone may for example halt usage of an earphone microphone signal recorded by said earphone microphone.

In a next step M10, an earphone loudspeaker of the principal earphone is communicatively disabled. The audio signal processor of the principal earphone may, for example, attenuate an audio signal provided to the earphone loudspeaker or stop an audio signal from being transmitted to the earphone loudspeaker.

In a next step M11, the headphone microphone signal is recorded using a headphone microphone of the headphones module.

In a next step M12, the headphone microphone signal is transmitted to the audio signal processor of the principal earphone In a next step M13, the headphone microphone signal is processed by the audio signal processor to generate an active noise control signal based on the headphone microphone signal. The active noise control may, for example, approximate an additive inverse of the headphone microphone signal.

In a next step M14, the active noise control signal is provided to the headphone loudspeaker via the earphone audio output and the headphone audio input. Thus, unwanted noise, for example, from an external environment, can be reduced, e.g., in the ear canal of a user, by reproduction of the active noise control signal by a headphone loudspeaker.

Note that embodiments of the invention are not restricted to a particular order of method steps.

In an embodiment of the invention, said principal earphone comprises at least one earphone microphone for generating at least one earphone microphone signal wherein said at least one earphone microphone is communicatively connected to said audio signal processor.

An earphone microphone is advantageous since it allows microphone functionality when the earphones module is used alone. Further, the earphone microphone may be used in combination with the any headphone microphones when the modules are sued together, which is advantageous.

In an embodiment of the invention, said headphones module comprises a headphone battery and a headphone battery interface communicatively connected to said headphone battery, wherein said principal earphone comprises an earphone battery and an earphone battery interface communicatively connected to said earphone battery, wherein said headphone battery interface is capable of communicatively connecting or disconnecting with said earphone battery interface, and wherein said earphone battery is configured to be receive power from said headphone battery via said headphone battery interface and said earphone battery interface.

Due to the typical size of a headphones module compared to earphones of an earphones module, the headphones module may potentially hold a significantly larger battery capacity. In contrast, earphones of an earphones module may typically have restricted battery power.

The headphones module may thus serve as a power bank or a charging station for earphones of the earphones module which is advantageous.

In an embodiment of the invention, said modular head-wearable loudspeaker system is arranged to provide said at least one of said at least one headphone microphone signal to a peripheral device via said earphone wireless interface.

The peripheral device may for example be a peripheral audio source, e.g., a smartphone, but is not restricted to this. Providing the headphone microphone signal to a peripheral device is advantageous since it may facilitate telecommunication.

The audio signal processor may also process, e.g., filter or amplify/attenuate, a headphone microphone signal prior to providing it to a peripheral device.

In an embodiment of the invention, said audio signal processor is arranged to generate an active noise control signal based on at least one of said at least one headphone microphone signal and to provide said active noise control signal to any of said headphone loudspeakers via said earphone audio output and said headphone audio input.

Active noise control may be understood as a method for reducing unwanted sound by addition of a signal which has opposite sound pressure compared to the unwanted sound. This opposite sound pressure may for example be based on an active noise control signal provided to a headphone loudspeaker. Active noise control may also be referred to as active noise reduction or active noise cancellation and may be thought of as a type of feedback. Typically, at least one microphone is used to record sound, e.g., a headphones microphone. Based on this recorded sound, an active noise control signal is generated. The active noise control signal may for example be substantially similar to an additive inverse of the recorded headphone microphone signal. The active noise control may further take into account various microphone transfer functions, loudspeaker transfer function, and/or sound transfer functions trough any parts of the head-wearable loudspeaker system. An active noise control signal and an audio signal may be provided to a loudspeaker simultaneously.

Generating an active noise control signal based on a headphone microphone signal is advantageous, since it facilitates active noise control.

In an embodiment of the invention, said active noise control signal is further based on at least one of said at least one earphone microphone signal.

Utilizing more microphone signals is advantageous, since this may improve the active noise control.

In an embodiment of the invention, said audio signal processor is arranged to: process said audio signal to generate an earphone audio signal and a headphone audio signal; provide said earphone audio signal to said earphone loudspeaker; and provide said headphone audio signal to any of said headphone loudspeakers via said earphone audio output and said headphone audio input.

In an embodiment of the invention, said earphone audio signal and said headphone audio signal are different audio signals.

In an embodiment of the invention, said earphone audio signal and said headphone audio signal are identical audio signals.

When the two modules are combined, any headphone loudspeaker and any earphone loudspeaker may reproduce audio signals as sound simultaneously. A headphone loudspeaker may for example provide a superior quality of bass frequency reproduction, whereas an earphone loudspeaker may provide a superior quality of treble frequency reproduction. The audio signal processor may provide the same or similar audio signals to the any of the headphone and earphone loudspeakers, or it may filter and/or attenuate/amplify an audio signal to provide different audio signals to the any of the headphone loudspeakers and earphone loudspeakers. For example, such that bass frequencies may primarily be provided to headphone loudspeakers, and treble frequencies may primarily be provided to earphone loudspeakers.

Providing audio signals to both any of the headphone loudspeakers and also to any of the earphone loudspeakers is advantageous, since it may be used to improve sound quality and/or sound pressure level.

In such embodiments, the earphone loudspeaker may preferably be acoustically coupled to the ear canal when the modules are worn together, e.g., via an acoustic canal.

In an embodiment of the invention, said principal earphone comprises a mechanical headphone attachment interface, wherein said at least one mechanical earphone attachment interface is detachably attached to said principal earphone via said mechanical headphone attachment interface.

A mechanical headphone attachment interface may be used to facilitate attachment of the earphones module to the headphones module, which is advantageous.

In an embodiment of the invention, said mechanical earphone attachment interface is an earphone insertion groove arranged to detachably attach said principal earphone.

In an embodiment of the invention, said earphone insertion groove is located in any of said first and second earcup.

An earphone insertion groove may for example be designed to fit the outer body of the principal earphone. The insertion groove may for example be combined with a headphone audio input and a headphone microphone input, such that signals can be exchanged with an earphone inserted in the insertion groove.

An insertion groove is advantageous, since it allows combination with inputs and outputs. It is further advantageous, since it allows the body of the principal earphone to be integrated into the body of the headphones module, e.g., into the body of one of the earcups of the headphones module.

In an embodiment of the invention, the mechanical headphone attachment interface is an outer body of said principal earphone detachably attachable into said earphone insertion groove.

In an embodiment of the invention, said mechanical earphone attachment interface is based on an earphone magnet and said mechanical headphone attachment interface is based on a headphone magnet.

Magnets are advantageous since they allow rapid and easy attachment and detachment.

In an embodiment of the invention, said mechanical earphone attachment interface is based on a clamp.

A clamp is advantageous since it allows a secure attachment of an earphone.

In an embodiment of the invention, said earphone audio output and at least one of said at least headphone audio input are galvanically connected audio signal terminals.

In an embodiment of the invention, said earphone microphone input and at least one of said at least one headphone microphone output are galvanically connected microphone signal terminals.

Galvanic connections are advantageous, since they permit straightforward communication of signals. Note that these galvanic connections may be broken when the two modules are detached.

In an embodiment of the invention, said earphone audio output and said headphone audio input are an audio socket and an audio plug which are galvanically connected.

In an embodiment of the invention, said earphone microphone input and at least one of said at least one headphone microphone output are a microphone socket and a microphone plug which are galvanically connected.

Plugs and sockets are advantageous since they allow a secure facilitation of signal communication. They may further serve as attachment interfaces.

In an embodiment of the invention, said earphone audio output and at least one of said at least headphone audio input are detachably communicatively connected at least partly wirelessly.

In an embodiment of the invention, said earphone microphone input and at least one of said at least one headphone microphone output are detachably communicatively connected at least partly wirelessly.

A wireless connection is advantageous since it allows omitting a wired/galvanic connection.

In an embodiment of the invention, said principal earphone comprises a mechanical headphone attachment interface arranged to detachably attach said headphones module.

The mechanical headphone attachment interface may for example be a shape of the outer body of the principal earphone, a magnet, a clamp, etc.

Having a headphone attachment interface is advantageous, since it allows attaching the headphones module.

In an embodiment of the invention, said earphones module comprises an auxiliary earphone, wherein said auxiliary earphone comprises an auxiliary earphone loudspeaker.

Thus, in some embodiments of the invention, the earphones module comprises both a principal earphone and an auxiliary earphone. This pair of earphones may for example be used to provide an audio signal to both ears of a user, which is advantageous. They may also both be attachable to a headphones module, allowing further sharing of elements and components which is advantageous.

The auxiliary earphone loudspeaker may typically be of the same type as the earphone loudspeaker. In an embodiment of the invention, the auxiliary earphone loudspeaker is an earphone loudspeaker, such that each of the principal earphone and the auxiliary earphone comprises an earphone loudspeaker.

In an embodiment of the invention, said earphones module comprises at least two earphone microphones.

Having at least two microphones in the principal earphone is advantageous, since it allows improved quality of microphone functions. For example, in telecommunication, two microphones may be utilized to isolate the speech of a user from environmental sound.

In an embodiment of the invention, said audio signal processor is arranged to generate an active noise control signal based on at least one of said at least one earphone microphone signal and to provide said active noise control signal to said earphone loudspeaker.

The earphones module may, thus, be capable of providing active noise control independently of the headphones module by generating an active noise control signal based on an earphone microphone signal, which is advantageous.

In an embodiment of the invention, said audio signal processor is a digital signal processer.

Using a digital signal processor is advantageous since it allows facilitation of signal processing and signal transmission. It may for example be powered by a battery built into the principal earphone.

In an embodiment of the invention, at least one of said at least one earphone microphone is a microelectrical-mechanical system microphone.

A microelectrical-mechanical system microphone may also be referred to as a MEMS microphone, a microphone chip, or a silicon microphone. It may have an associated analogue-to-digital converter. The small size of MEMS microphones allows fewer restrictions to locations, which is advantageous.

In an embodiment of the invention, at least one of said at least one earphone microphone is a unidirectional microphone.

Unidirectional microphones have directional sensitivity, which is advantageous for some applications.

In an embodiment of the invention, said earphones module comprises at least two earphone microphones wherein each of said at least two earphone microphones have a different direction of sensitivity.

Several microphones with different directions of sensitivity may be employed to obtain improved directional sensitivity, which is advantageous.

In an embodiment of the invention, said headphones module comprises at least two headphone microphones, wherein said at least two headphone microphones are located in said first earcup.

In an embodiment of the invention, said headphones module comprises four headphone microphones, wherein two of said four headphone microphones are located in said first earcup and two others of said four headphone microphones are located in said second earcup.

Having at least two microphones, e.g., two or four microphones, in the headphones module is advantageous, since it allows improved quality of microphone functions. For example, in telecommunication, two microphones may be utilized to isolate the speech of a user from environment sound.

In an embodiment of the invention, said headphones module is a passive loudspeaker system.

Constructing the headphones module as a passive loudspeaker system, i.e., a loudspeaker system without an audio signal processer and/or audio signal amplification, is advantageous, since it simplifies the design and the environmental footprint of the headphones module, which is advantageous.

In an embodiment of the invention, said headphones module comprises at least one peripheral audio input communicatively connected to any of said headphone loudspeakers for providing an auxiliary audio signal to any of said headphone loudspeakers from a peripheral audio source communicatively connected to at least one of said at least one peripheral audio input.

Having a peripheral audio input allows the headphones to receive audio independent from the earphones module, which is advantageous. In typical embodiments, a peripheral audio input is arranged to receive an auxiliary audio signal trough a wired connection. In some embodiments, the peripheral audio input is arranged to receive an auxiliary audio signal through a wireless connection.

In an embodiment of the invention, at least one of said at least one headphone microphone is located in a headphone microphone arm.

A microphone arm may for example be an elongated or slender member protruding from the headphones module, attached to the headphones module in one end and with a headphone microphone located in the other end. Such a headphone microphone arm may for example be arranged to place the headphone microphone in vicinity of the mouth of a user to improve the recording of speech of that user.

In an embodiment of the invention, at least one of said at least one headphone microphone is located in said flexible headband.

Placing a headphone microphone in the flexible headband may for example allow better microphone sensitivity from certain directions, which is advantageous.

In an embodiment of the invention, at least one of said at least one headphone microphone is a microelectrical-mechanical system microphone.

The small size of MEMS microphones allows fewer restrictions to locations, which is advantageous.

In an embodiment of the invention, at least one of said at least one headphone microphone is a unidirectional microphone.

Unidirectional microphones have directional sensitivity, which is advantageous for some applications.

In an embodiment of the invention, said headphones module comprises at least two headphone microphones wherein each of said at least two headphone microphones has a different direction of sensitivity.

Several microphones with different directions of sensitivity may be employed to obtain improved directional sensitivity, which is advantageous.

In an embodiment of the invention, said step of attaching said principal earphone is attaching a mechanical headphone attachment interface of said principal earphone to said mechanical earphone attachment interface.

A headphone attachment interface may be used to facilitate attachment of the modules in combination with an earphone attachment interface to provide easier or a more secure attachment, which is advantageous.

In an embodiment of the invention, said method comprises a step of communicatively disabling an earphone microphone of said principal earphone.

Disabling an earphone microphone may be understood as not using an earphone microphone signal recorded by the earphone microphone in the step of processing the headphone microphone signal. In some embodiments, disabling may be performed by opening a switch connecting to the earphone microphone. In other embodiments, the earphone microphone may continuously provide an earphone microphone signal to the audio signal processor, but upon disabling the earphone microphone, the audio signal processor ceases any usage of that signal fully. Or alternatively, the audio signal processor ceases usage of that earphone microphone signal for the same processing purposes as the processing of the headphones microphones signal.

Disabling the earphone microphone is advantageous, since headphone microphone may provide a microphone signal of higher quality, and accordingly, only using a headphone microphone signal may improve the quality of the output of the processing, e.g. the quality of an active noise control signal.

In an embodiment of the invention, said method comprises a step of communicatively connecting an earphone audio output of said principal earphone with a headphone audio input of said headphones module, wherein said headphone audio input is communicatively connected to at least one headphone loudspeaker of said headphones module.

In an embodiment of the invention, said method comprises a step of providing a processed audio signal from said audio signal processor to at least one of said at least one headphone loudspeaker.

A processed audio signal may for example be an audio signal received by the audio signal processer via a wireless interface of the principal earphone, or it may be an active noise control signal.

Communicatively connecting an earphone audio output with a headphone audio input is advantageous since it allows transmission of audio signals and/or processed audio signals, which is advantageous.

In an embodiment of the invention, said method comprises a step of communicatively disabling at least one earphone loudspeaker of said principal earphone.

Disabling an earphone loudspeaker may be understood as not providing an audio signal to that earphone loudspeaker, for instance while providing an audio signal to at least one headphone loudspeaker.

Disabling an earphone loudspeaker is advantageous, since sound of the earphone loudspeaker may distort sound of the headphone loudspeaker, as heard by a user.

In an embodiment of the invention, said method comprises a step of recording an earphone microphone signal using an earphone microphone of said principal earphone, wherein said step of processing said headphone microphone signal comprises processing said earphone microphone signal.

Utilizing the earphone microphone may lead to an improved output of the processing, for example lead to an improved active noise control signal, which is advantageous.

In an embodiment of the invention, said step of processing said headphone microphone signal comprises generating an active noise control signal in said audio signal processor based on said headphone microphone signal, wherein said method further comprises a step of providing said active noise control signal to at least one of said at least one headphone loudspeaker via said earphone audio output and said headphone audio input.

Generating and providing the active noise control signal allows facilitation of active noise control to a user, which is advantageous.

In an embodiment of the invention, said active noise control signal is further based on an earphone microphone signal generated by an earphone microphone of said principal earphone.

Employing multiple microphones for generating an active noise control may provide an improved quality of the active noise control signal, which is advantageous.

In an embodiment of the invention, said step of processing said headphone microphone signal comprises generating a peripheral communication signal in said audio signal processor based on said headphone microphone signal, wherein said method further comprises a step of wirelessly transmitting said peripheral communication signal from said earphones module to a peripheral device via an earphone wireless interface of said earphones module.

Generating a peripheral communication signal and transmitting it to a peripheral device allows facilitation of telecommunication, which is advantageous.

A peripheral device may for example be the same device as the peripheral audio source, but this is not necessarily always the case. A peripheral device may for example be a smartphone.

In an embodiment of the invention, said peripheral communication signal is further based on an earphone microphone signal generated by an earphone microphone of said principal earphone.

Employing multiple microphones for generating a peripheral communication signal may provide an improved quality of the peripheral communication signal, which is advantageous.

In an embodiment of the invention, said step of processing said headphone microphone signal comprises generating a voice control signal based on said headphone microphone signal and a step of executing a voice control command based on said voice control signal.

Generating a voice control signal and executing a voice control command based on that signal is advantageous, since it allows a user to control the headphones and/or earphones module using voice commands. A voice control command may for example be used to change volume, initiate/end telecommunication, initiate/end active noise control, initiate/end replaying an audio signal such as music or radio, etc.

In an embodiment of the invention, said voice control signal is further based on an earphone microphone signal generated by an earphone microphone of said principal earphone.

Employing multiple microphones for generating a voice control signal may provide an improved quality of the voice control signal, which is advantageous.

From the above, it is clear that the invention relates a modular head-wearable loudspeaker system. The loudspeaker system features two modules: an earphones module and a headphones module. These two modules may be worn and combined in various configurations depending on the needs of a user. Accordingly, the one of the modules may utilize elements of the other modules. Particularly, an audio signal processor of the earphones module can utilize headphone microphones and headphone microphones signals of the headphones module, for example to improve active noise control or telecommunication. This further ensures that the number of necessary components for realizing a modular head-wearable loudspeaker system with microphone functionality is minimized.

The invention has been exemplified above with the purpose of illustration rather than limitation with reference to specific examples of methods and embodiments. Details such as a specific method and system structures have been provided in order to understand embodiments of the invention. Note that detailed descriptions of well-known systems, devices, circuits, and methods have been omitted so as to not obscure the description of the invention with unnecessary details. It should be understood that the invention is not limited to the particular examples described above and a person skilled in the art can also implement the invention in other embodiments without these specific details. As such, the invention may be designed and altered in a multitude of varieties within the scope of the invention as specified in the claims.

The invention claimed is:

1. A modular head-wearable loudspeaker system comprising:

an earphones module comprising:

a principal earphone comprising:

an earphone loudspeaker;

an audio signal processor;

an earphone wireless interface communicatively connected to said earphone loudspeaker through said audio signal processor for receiving an audio signal from a peripheral audio source communicatively connected to said earphone wireless interface;

an earphone audio output communicatively connected to said earphone wireless interface through said audio signal processor; and an earphone microphone input communicatively connected to said audio signal processor; and headphones module comprising:

a first earcup and a second earcup interconnected by a flexible headband for wearing said headphones module, wherein said first earcup and said second earcup comprise headphone loudspeakers such that each of said first earcup and said second earcup comprises a respective headphone loudspeaker of said headphone loudspeakers;

at least one headphone microphone for generating at least one headphone microphone signal;

at least one mechanical earphone attachment interface detachably attached to said principal earphone;

at least one headphone audio input communicatively connected to any of said headphone loudspeakers and detachably communicatively connected to said earphone audio output for providing said audio signal from said earphones module to any of said headphone loudspeakers; and at least one headphone microphone output communicatively connected to at least one of said at least one headphone microphone and communicatively connected to said earphone microphone input for providing at least one of said at least one headphone microphone signal to said audio signal processor.

2. The modular head-wearable loudspeaker system according to claim 1, wherein said headphones module comprises a headphone battery and a headphone battery interface communicatively connected to said headphone battery, wherein said principal earphone comprises an earphone battery and an earphone battery interface communicatively connected to said earphone battery, wherein said headphone battery interface is detachably communicatively connected to said earphone battery interface, and wherein said earphone battery is configured to receive power from said headphone battery via said headphone battery interface and said earphone battery interface.

3. The modular head-wearable loudspeaker system according to claim 1, wherein said modular head-wearable loudspeaker system is arranged to provide said at least one headphone microphone signal to a peripheral device via said earphone wireless interface.

4. The modular head-wearable loudspeaker system according to claim 1, wherein said audio signal processor is arranged to generate an active noise control signal based on said at least one headphone microphone signal and to provide said active noise control signal to any of said headphone loudspeakers via said earphone audio output and said headphone audio input.

5. The modular head-wearable loudspeaker system according to claim 1, wherein said audio signal processor is arranged to:

process said audio signal to generate an earphone audio signal and a headphone audio signal;

provide said earphone audio signal to said earphone loudspeaker; and provide said headphone audio signal to any of said headphone loudspeakers via said earphone audio output and said headphone audio input.

6. The modular head-wearable loudspeaker system according to claim 1, wherein said principal earphone comprises a mechanical headphone attachment interface, and wherein said at least one mechanical earphone attachment interface is detachably attached to said principal earphone via said mechanical headphone attachment interface.

7. The modular head-wearable loudspeaker system according to claim 1, wherein said mechanical earphone attachment interface is an earphone insertion groove arranged to detachably attach said principal earphone.

8. An earphones module for a modular head-wearable loudspeaker system, said earphones module comprising:

a principal earphone comprising:

an earphone loudspeaker;

an audio signal processor;

at least one earphone microphone for generating at least one earphone microphone signal wherein said at least one earphone microphone is communicatively connected to said audio signal processor;

an earphone wireless interface communicatively connected to said earphone loudspeaker through said audio signal processor and arranged to detachably connect with an earphone audio input of a headphones module for providing an audio signal from a peripheral audio source to said headphones module;

an earphone audio output communicatively connected to said earphone wireless interface through said audio signal processor; and an earphone microphone input communicatively connected to said audio signal processor and arranged to detachably connect with a headphone microphone output of said headphones module for receiving a signal of a headphone microphone of said headphones module by said audio signal processor.

9. The earphones module according to claim 8, wherein said earphones module comprises an auxiliary earphone, and wherein said auxiliary earphone comprises an auxiliary earphone loudspeaker.

10. The earphones module according to claim 8, wherein said earphones module comprises at least two earphone microphones.

11. The earphones module according to claim 8, wherein said audio signal processor is configured to process:

said at least one earphone microphone signal when said headphones module is detached from said earphones module; and said headphone microphone signal when said headphones module is attached to said earphones module.

12. A headphones module for a modular head-wearable loudspeaker system, said headphones module comprising:

a first earcup;

a second earcup;

a flexible headband, interconnecting said first earcup and said second earcup, for wearing said headphones module, wherein said first earcup and said second earcup comprise headphone loudspeakers such that each of said first earcup and said second earcup comprises a respective headphone loudspeaker of said headphone loudspeakers;

at least one headphone microphone for generating at least one headphone microphone signal;

at least one mechanical earphone attachment interface arranged to detachably attach an earphones module;

at least one headphone audio input communicatively connected to any of said headphone loudspeakers and arranged to detachably connect with an earphone audio output of said earphones module for providing an audio signal received from an audio signal processor of said earphones module to any of said headphone loudspeakers; and at least one headphone microphone output communicatively connected to said at least one headphone microphone and arranged to detachably connect with an earphone microphone input of said earphones module for providing a signal of said at least one headphone microphone from said headphone module to said audio signal processor of said earphones module.

13. The headphones module according to claim 12, wherein said headphones module comprises at least one peripheral audio input communicatively connected to any of said headphone loudspeakers for providing an auxiliary audio signal to any of said headphone loudspeakers from a peripheral audio source communicatively connected to at least one of said at least one peripheral audio input.

14. The headphones module according to claim 12, wherein said headphones module comprises at least two headphone microphones, and wherein said at least two headphone microphones are located in said first earcup.

15. The headphones module according to claim 12, wherein said headphones module is a passive loudspeaker system.

16. The headphones module according to claim 12, wherein said audio signal processor is configured to process said signal of said at least one headphone microphone when said earphones module is attached to said headphones module.

17. A method for facilitating processing of a headphone microphone signal, said method comprising:

attaching a principal earphone of an earphones module to a mechanical earphone attachment interface of a headphones module;

communicatively connecting a headphone microphone output of said headphones module with an earphone microphone input of said principal earphone;

recording said headphone microphone signal using a headphone microphone of said headphones module;

transmitting said headphone microphone signal to an audio signal processor of said principal earphone via said headphone microphone output and said earphone microphone input; and processing said headphone microphone signal by said audio signal processor.

18. The method according to claim 17, further comprising communicatively disabling an earphone microphone of said principal earphone.

19. The method according to claim 17, further comprising communicatively connecting an earphone audio output of said principal earphone with a headphone audio input of said headphones module, wherein said headphone audio input is communicatively connected to at least one headphone loudspeaker of said headphones module.

20. The method according to claim 19, wherein said processing said headphone microphone signal comprises generating an active noise control signal in said audio signal processor based on said headphone microphone signal, and wherein said method further comprises providing said active noise control signal to at least one of said at least one headphone loudspeaker via said earphone audio output and said headphone audio input.

21. The method according to claim 17, further comprising communicatively disabling at least one earphone loudspeaker of said principal earphone.

22. The method according to claim 17, wherein said processing said headphone microphone signal comprises generating a peripheral communication signal in said audio signal processor based on said headphone microphone signal, and wherein said method further comprises wirelessly transmitting said peripheral communication signal from said earphones module to a peripheral device via an earphone wireless interface of said earphones module.

* * * * *